US011717870B2

(12) United States Patent
Pasotti

(10) Patent No.: US 11,717,870 B2
(45) Date of Patent: Aug. 8, 2023

(54) CONTINUOUS METHOD FOR PRODUCING CAPILLARIES MADE OF NONFERROUS ALLOYS

(71) Applicant: FEINROHREN S.P.A., Passirano (IT)

(72) Inventor: Mark Pasotti, Gussago (IT)

(73) Assignee: FEINROHREN S.P.A., Passirano (IT)

( * ) Notice: Subject to any disclaimer, the term of this patent is extended or adjusted under 35 U.S.C. 154(b) by 0 days.

(21) Appl. No.: 17/257,970

(22) PCT Filed: Apr. 10, 2019

(86) PCT No.: PCT/EP2019/059124
§ 371 (c)(1),
(2) Date: Jan. 5, 2021

(87) PCT Pub. No.: WO2020/007514
PCT Pub. Date: Jan. 9, 2020

(65) Prior Publication Data

US 2021/0220887 A1 Jul. 22, 2021

(30) Foreign Application Priority Data

Jul. 5, 2018 (IT) ..... 102018000006938

(51) Int. Cl.
*B21C 23/00* (2006.01)
*F25B 41/37* (2021.01)
*B21C 1/22* (2006.01)

(52) U.S. Cl.
CPC ..... *B21C 23/005* (2013.01); *B21C 1/22* (2013.01); *B21C 23/002* (2013.01); *F25B 41/37* (2021.01)

(58) Field of Classification Search
CPC ..... B21C 1/22; B21C 23/002; B21C 23/005; B21C 23/085; B21C 23/217; B21C 1/02; F25B 41/37
See application file for complete search history.

(56) References Cited

U.S. PATENT DOCUMENTS 3,765,216 A 10/1973 Green
4,055,979 A 11/1977 Hunter et al.
4,110,892 A * 9/1978 Bangay ..... B22F 3/20 419/67
4,163,377 A * 8/1979 Moreau ..... B21C 23/008 72/262
4,393,917 A * 7/1983 Fuchs, Jr. ..... B21C 23/005 164/417
4,408,467 A * 10/1983 Murnane ..... F25B 41/40 62/511
4,598,567 A * 7/1986 Backus ..... B21C 25/025 72/262
5,119,660 A * 6/1992 Koppinen ..... B21C 29/00 72/253.1
5,157,955 A * 10/1992 Hawkes ..... B21C 23/005 72/262
5,167,138 A 12/1992 Sinha et al.
6,634,415 B1 * 10/2003 Maddock ..... B21C 23/005 164/151.2
7,732,059 B2 6/2010 Ren et al.
2014/0227130 A1 * 8/2014 Ohashi ..... B21C 1/00 420/532
2017/0051384 A1 * 2/2017 Stull ..... B22D 11/1206
2018/0202026 A1 * 7/2018 Dolega ..... C22F 1/047

FOREIGN PATENT DOCUMENTS

CN 102615139 A 8/2012
CN 103769831 A1 5/2014
CN 104607484 A 5/2015
CN 105132752 A 12/2015
CN 106825091 A 6/2017
CN 107008764 A 8/2017
EP 1840487 A1 10/2007
RU 2053033 C1 1/1996
RU 2111811 C1 5/1998
RU 2164832 C2 4/2001
SU 374110 A1 3/1973
SU 483165 A1 9/1975
WO 2012005599 A1 1/2012

OTHER PUBLICATIONS

Translation, CN 106825091A, Ji et al., Jun. 2017.*
International Search Report dated Jun. 19, 2019 re: Application No. PCT/EP2019/0599124, pp. 1-4, citing: EP 1 840 487 A1, U.S. Pat. No. 7,732,059 B2, CN 107 008 764 A, WO 2012/005599 A1.
IT Search Report dated Mar. 19, 2019 re: Application No. IT 201800006938, pp. 1-7, citing: EP 1 840 487 A1, U.S. Pat. No. 7,732,059 B2, CN 107 008 764 A and WO 2012/005599 A1.
Written Opinion dated Jun. 19, 2019 re: Application No. PCT/EP2019/0599124, pp. 1-6, citing: EP 1 840 487 A1, U.S. Pat. No. 7,732,059 B2, CN 107 008 764 A, WO 2012/005599 A1.
RU Office Action dated Aug. 8, 2022 re: Application No. 202110196405 (004070), pp. 1-7.
Brazilian Office Action for Brazilian Application BR112020026237-4, dated Jan. 30, 2023, 2 pages.
Chinese Office Action for Application No. 2019800446348 dated Jan. 19, 2023, 7 pages.

* cited by examiner

*Primary Examiner* — Edward T Tolan
(74) *Attorney, Agent, or Firm* — Cantor Colburn LLP

(57) ABSTRACT

A method for producing capillaries from nonferrous alloys, in particular of Al, which includes the continuous cold rotary extrusion of a blank having a solid cross-section, obtained by casting, in order to produce a tube having a hollow cross-section. The deformation of the blank to be extruded is achieved only by using friction force. The method further includes at least one step of cold drawing of the extruded tube in order to reduce its diameter to the diameters corresponding to a capillary.

5 Claims, No Drawings

CONTINUOUS METHOD FOR PRODUCING CAPILLARIES MADE OF NONFERROUS ALLOYS

TECHNICAL FIELD

The present disclosure relates to a continuous method for producing capillaries made of non-ferrous metals and alloys. Although the method of the disclosure can be applied to a vast range of non-ferrous metals and alloys e.g. to copper, zinc, lead, magnesium, silver, gold etc., and alloys thereof, it has been found to be particularly useful in processing the aluminum alloys that have wide commercial use.

BACKGROUND

The use of capillaries has become increasingly widespread in the field of thermal expansion valves used in the cooling circuits of electrical household appliances.

The widespread use of these valves has required the development of methods of mass production of such capillaries, which ensure the quantity and quality of the capillaries, e.g. in terms of high productivity and of constant structural characteristics. To this end, copper and its alloys have been found to be best adapted to meet the requirements of high productivity and constant structural characteristics. However, owing to the high cost of copper, the necessity has arisen to produce capillaries from alternative, cheaper materials, in particular from alloys of aluminum.

Use of alloys of aluminum for the mass production of capillaries has required particular contrivances in order to meet the requirements in terms of adequate structural and mechanical characteristics to permit the continuous production, with no defects and interruptions, of coils of sufficient lengths, e.g. a length that exceeds 100 m, and preferably exceeds 1000 m, e.g. up to 5 km and beyond. The processes currently in use for the continuous mass production of coils of capillaries generally comprise the hot-extrusion of starting materials having a solid cross-section, obtained by casting, e.g. billets, followed by subsequent stages of cold drawing. In the application of such conventional processes, it has been found that not all alloys of aluminum are suitable for continuous production in that they give rise to structural weaknesses and breakages, or at least to defects of the capillaries in substantial lengths e.g. over 100 m.

In order to overcome the above mentioned problems, EP 1,840,487 has proposed a particular composition of aluminum alloy, which although belonging to the UNI 3103 series of such alloys, is a specific selection. According to this patent, what is claimed is a selected composition of Al alloy which is claimed to be the only one capable of withstanding the continuous production of capillaries of lengths greater than 100 m without undergoing breakages and/or defects and which is claimed to permit the production of capillaries with substantially constant internal diameters. In addition to the specific composition claimed therein, EP 1,840,487 also claims a corresponding method of continuous manufacture of Al alloys which entail the hot extrusion of starting billets, a subsequent drawing thereof down to the desired diameters of capillaries, washes of the inner surfaces of the coils of capillaries and, finally, a final heat treatment to increase the ductility of the capillaries obtained.

Also known in the known art are processes for producing tubes by way of rotary cold extrusion, e.g. U.S. Pat. No. 3,765,216. According to this technique, an intense friction is created between a wheel rotating about a pivot and a static wall of the apparatus, which produces the necessary heat for the yield of a metal to be extruded, without requiring external heat to be provided. U.S. Pat. No. 5,167,138 describes an apparatus for continuous rotary extrusion that comprises cooling means in order to ensure the uniformity of the grain sizes of the extruded product. Chinese patent application CN 102615139 proposes a particular alloy of Al, with a high content of Si, in order to improve the productivity of a continuous process of rotary extrusion of conventional tubes, with a diameter of 10-12 mm. In light of the problems with cold extrusion e.g. those described in the above mentioned documents, its use has not been proposed in the production of capillaries.

SUMMARY

The aim of the present disclosure is to provide a process for the mass production of capillaries, in particular starting from alloys of aluminum, which are advantageous in terms of costs with respect to capillaries based on copper and alloys thereof, such process being simplified, being economically more advantageous, and having a lower environmental impact with respect to the forming processes used to date.

Within this aim, the disclosure provides a process for the continuous, practically infinite, production of tubes that does not have the structural defects that typically result from hot extrusion, e.g. bamboo segments, swelling, cracking and inclusions, and which have an inner cross-section that is substantially constant, thus making it possible to use them for the production of capillaries, without requiring additional steps for their provision.

The disclosure also provides a process for producing capillaries that can be applied to non-ferrous alloys in general and, in particular, to alloys of aluminum with compositions that can vary within a wide range, including alloys in common use, which have no particular limitations or constraints corresponding to their chemical composition and which are freely available on the market, e.g. as semi-finished products having a solid cross-section.

This aim and these and other advantages which will become better apparent hereinafter are achieved by providing a method for producing capillaries from nonferrous alloys, which comprises a continuous cold rotary extrusion of an initial blank having a solid cross-section, produced by casting, in order to obtain a tube having a hollow cross-section, wherein the deformation of the blank to be extruded is achieved only by means of friction force, a cooling of the extruded tube to ambient temperature, and at least one step of cold drawing of the extruded tube in order to reduce its diameter to the diameters corresponding to a capillary.

DETAILED DESCRIPTION OF THE DISCLOSURE

The method according to the disclosure comprises therefore a first step of continuous cold rotary extrusion according to a technique described e.g. in U.S. Pat. No. 3,765,216 or U.S. Pat. No. 4,055,979, in which the blank to be extruded is fed cold, without heating beforehand, and it reaches the necessary deformation solely by way of a friction force generated in the extruder. In particular, according to such technique, an initial blank, which is commonly a wire rod having a solid cross-section, obtained conventionally by way of casting and cold rolling in a production line, is fed cold to a rotary extruder that comprises a steel rotating wheel, actuated by motor and reduction gear. The wheel is provided with an external, perimetric, endless groove, into which is inserted the wire rod which is entrained through an extrusion chamber and subjected therein to high friction force developed by friction between the wheel and a section of the wall of the chamber, e.g. by virtue of protrusions or spikes positioned thereon which make contact with the groove of the wheel during rotation. Then, in the friction zone the wire rod in the groove reaches the level of yield or deformation of the alloy of which it is made, permitting the extrusion thereof through a die plate, e.g. bridge-like, which is arranged in the extrusion chamber. Thus, in this first step of the process, a continuous rotary extrusion takes place in which the level of deformability is reached in any case and the extrusion of the wire rod occurs without applying external heat or induced heating.

In practice, a starting wire rod can be used in the form of a skein of weight that can be considerably greater than that usable in a hot extrusion process. For the purposes of illustration, a skein of 2000 kg can be used, placed e.g. on a pallet, which is unrolled and cleaned on the outer surface by way of brushing or passing in aqueous solutions, in the production line, and which is then fed to the continuous rotary extrusion. The wire rod can have an initial external diameter e.g. of 9.5-15 mm. While the process can be applied to various non-ferrous metals and alloys, e.g. including of copper, it is particularly advantageous in the manufacture of capillaries from alloys of aluminum in widespread demand, e.g. in the field of thermal expansion valves, by virtue of their low cost compared to copper and alloys of copper. It has in fact been found, advantageously, that the method of the present disclosure can be used with a wide range of alloys of aluminum with mechanical characteristics suitable for an easy deformability by extrusion, without other constraints or limitations in terms of chemical composition. Therefore the alloys of aluminum defined by the UNI EN 573-3 standard, series 1000 to 6000, can be used, for example the alloys of series 3000, for example the EN-AW 3103 alloy containing Si, Fe and Mg, which are far superior to the alloys of Al described in EP 1 840 487.

The tube exiting from the cold rotary extrusion machine is passed through a cooling and drying vat in order to cool it to ambient temperature.

The resulting extruded tube is then sent for induced current quality control, e.g. through guide loops, for the marking of any line defects, and then it can be sent to the subsequent steps of cold drawing, either immediately or after winding by way of winders to await such subsequent processes.

The method of the disclosure finally comprises at least one final stage of cold drawing, but, preferably, a succession of drawing stages for a gradual reduction of the diameter of the extruded tube until it reaches the desired diameter of the capillary, usually an inside diameter in the range of 0.2 to 4.5 mm. In practice the cold drawing is conventional, in which one or more cold reductions of the cross-section of the tubes are carried out with drawing lines, through conveniently dimensioned dies and spindles.

As can be seen from the foregoing, the method according to the disclosure presents considerable advantages by virtue of the use of a continuous cold rotary extrusion that does not make use of induced heating, in combination with the final cold drawing. By substituting the conventional hot extrusion for cold rotary extrusion, in which the heating is supplied by the friction force and the deformation is carried out by the wheel in rotation, the consumption of electricity is appreciably reduced, with a kw/ton ratio of consumption to product equal to a third of the common process of producing capillaries based on hot extrusion. Furthermore, the continuous cold extrusion process, in addition to not using induced heating, by virtue of its method of deformation on the rotating wheel, reduces the formation of oxides and does not require lubricating substances on the production utensils, so making the washing of the capillary tube optional and non-essential. In fact, in the hot extrusion process it can be necessary, in addition to the utensils, to lubricate the billet container with graphite, oil or specially-formulated polymers.

The environmental impact is appreciably mitigated in that the consumption of water resources is reduced below 50 $m^3/h$ of water, and of hydraulic oil for actuating the machines below 1 $m^3$, and at the same time carbon emissions are reduced. In fact, with induced heating not being necessary, no heating oven is needed, which conventionally would be an electric induction oven, and therefore would require a cooling system with consequent increase in the necessary volume of water. Alternatively, the consumption of methane gas used for methane-fueled heating ovens is eliminated.

Finally, the method of the disclosure makes it possible to produce capillaries of unlimited length, in any case exceeding 10000 mm and with substantially constant inner diameters that make possible minimal variations of flow-rate of fluid, and with optimal outer and inner roughness.

The disclosures in Italian Patent Application No. 102018000006938 from which this application claims priority are incorporated herein by reference.

The invention claimed is:

1. A method for producing capillaries from nonferrous alloys, the method including the following steps: a continuous cold rotary extrusion of an initial blank having a solid cross-section, produced by casting, in order to obtain a tube having a hollow cross-section, wherein a deformation of the blank to be extruded is achieved only by friction force, a cooling of the extruded tube to ambient temperature, and at least one step of cold drawing of the extruded tube in order to reduce a diameter thereof to diameters corresponding to a capillary, and a plurality of steps of cold drawing performed in succession until an inside diameter of the capillary in the range from 0.2 mm to 4.5 mm and a length of the capillary exceeding 10,000 mm with substantially constant inner diameters are obtained, wherein the initial blank is a wire rod with an initial external diameter of 9.5 mm-15 mm.

2. The method according to claim 1, further comprising a step of winding the extruded tube in the form of a coil before feeding to the step of cold drawing.

3. The method according to claim 1, wherein said nonferrous alloy is an aluminum alloy selected from the UNI EN 573-3 standard series from 1000 to 6000.

4. The method according to claim 1, wherein the alloy is an aluminum alloy of the UNI 3103 series.

5. The method according to claim 1, wherein the continuous cold rotary extrusion is achieved by using a wheel with an endless perimetric external groove in which said blank is accommodated and is fed to an extrusion chamber by a contact with protrusions in the extrusion chamber configured to generate sufficient friction to reach the deformation configured for the extrusion of the blank.

* * * * *